US011965261B2

(12) United States Patent
Cui et al.

(10) Patent No.: US 11,965,261 B2
(45) Date of Patent: Apr. 23, 2024

(54) ELECTROLYTIC PRODUCTION OF HIGH-PURITY LITHIUM FROM LOW-PURITY SOURCES

(71) Applicant: MetaGenesis, Ltd., Sunnyvale, CA (US)

(72) Inventors: Yi Cui, Stanford, CA (US); Yang Jin, Zhengzhou (CN); Hui Wu, Beijing (CN); Kai Liu, Beijing (CN); Jialiang Lang, Fushun (CN)

(73) Assignee: MetaGenesis, Ltd., Sunnyvale, CA (US)

( * ) Notice: Subject to any disclaimer, the term of this patent is extended or adjusted under 35 U.S.C. 154(b) by 0 days.

(21) Appl. No.: 17/418,420

(22) PCT Filed: Dec. 13, 2019

(86) PCT No.: PCT/CN2019/125337

§ 371 (c)(1),
(2) Date: Jun. 25, 2021

(87) PCT Pub. No.: WO2020/135112

PCT Pub. Date: Jul. 2, 2020

(65) Prior Publication Data

US 2022/0074062 A1 Mar. 10, 2022

(30) Foreign Application Priority Data

Dec. 28, 2018 (WO) ..... PCT/CN2018/124602

(51) Int. Cl.

| | |
|---|---|
| ***C25C 7/00*** | (2006.01) |
| ***C25C 3/02*** | (2006.01) |
| ***C25C 7/02*** | (2006.01) |
| ***C25C 7/04*** | (2006.01) |

(52) U.S. Cl.
CPC ..... *C25C 3/02* (2013.01); *C25C 7/025* (2013.01); *C25C 7/04* (2013.01)

(58) Field of Classification Search
CPC ..... C25C 3/02; C25C 7/025; C25C 7/04
See application file for complete search history.

(56) References Cited

U.S. PATENT DOCUMENTS

| | | | |
|---|---|---|---|
| 4,089,770 | A | 5/1978 | Lemke |
| 4,758,316 | A | 7/1988 | Stewart, Jr. et al. |
| 6,287,448 | B1 | 9/2001 | Schierle-Arndt et al. |

(Continued)

FOREIGN PATENT DOCUMENTS

| | | | |
|---|---|---|---|
| CA | 2880255 | A1 | 1/2014 |
| CN | 202755066 | U | 2/2013 |

(Continued)

OTHER PUBLICATIONS

International Search Report and Written Opinion for PCT/CN2019/125337 dated Mar. 13, 2020, 7 pages.

*Primary Examiner* — Zulmariam Mendez

(57) ABSTRACT

Devices and methods for purifying lithium from lithium salts, including those with low concentration of lithium salts, are provided. A molten composition comprising a lithium salt is electrolyzed with an anode in contact with the molten composition and a cathode separated from the molten composition by a solid electrolyte capable of conducting lithium ions.

18 Claims, 7 Drawing Sheets

(56) References Cited

U.S. PATENT DOCUMENTS

| | | | | |
|---|---|---|---|---|
| 2014/0186720 | A1* | 7/2014 | Kintaka | C01G 25/006 429/322 |
| 2014/0199577 | A1* | 7/2014 | Bhavaraju | H01M 6/185 429/105 |
| 2017/0324079 | A1 | 11/2017 | Kataoka et al. | |
| 2020/0274193 | A1* | 8/2020 | Hamao | H01B 1/06 |

FOREIGN PATENT DOCUMENTS

| | | | |
|---|---|---|---|
| CN | 202898560 | U | 4/2013 |
| CN | 103205774 | A | 7/2013 |
| CN | 203373435 | U | 1/2014 |
| CN | 203700537 | U | 7/2014 |
| JP | 2015529745 | A | 10/2015 |
| TW | 200846507 | A | 12/2008 |
| WO | 2016068040 | A1 | 5/2016 |

* cited by examiner

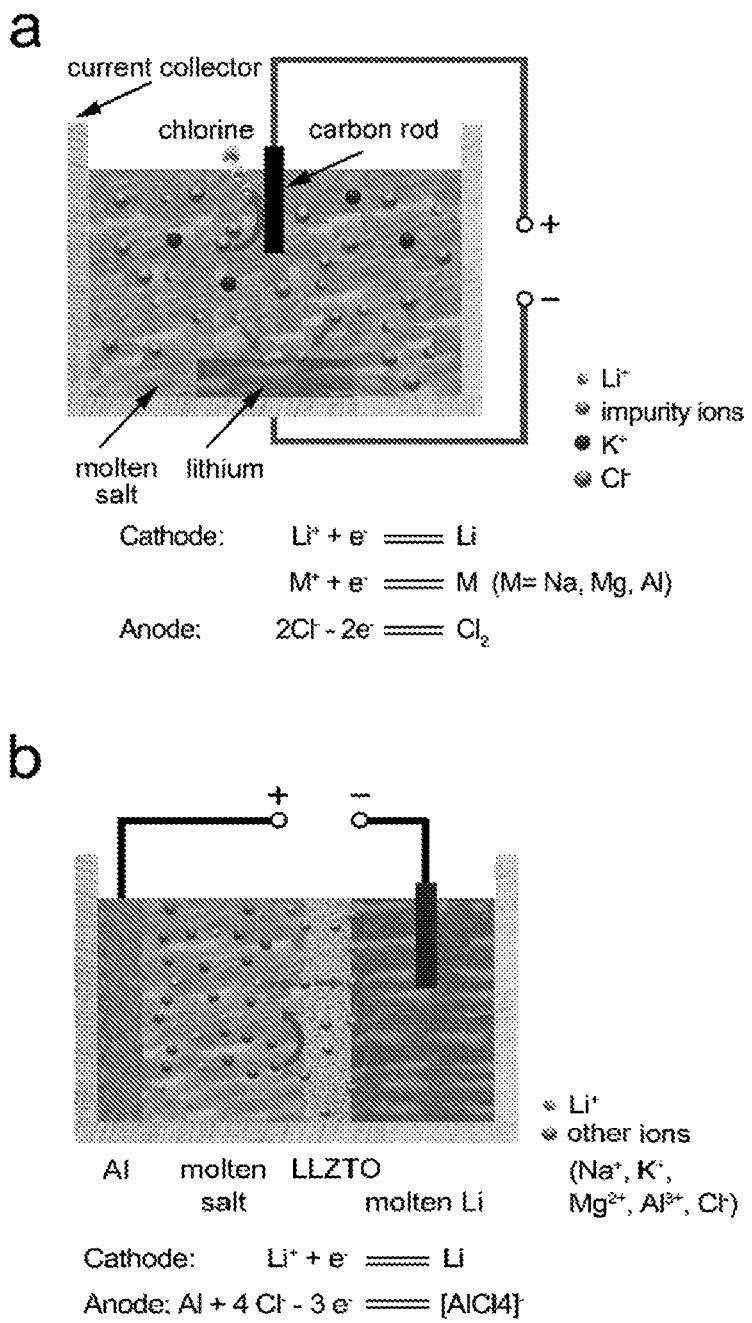
FIG. 2a-b

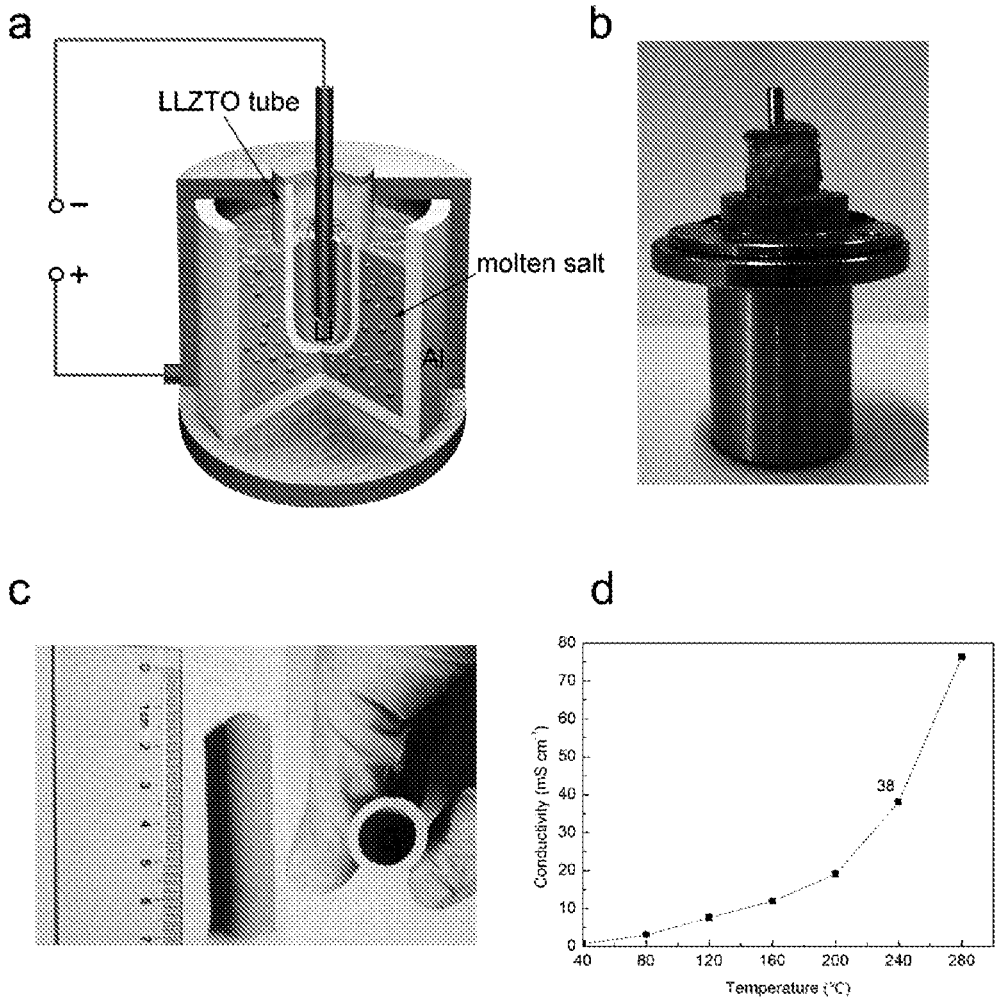
FIG. 3a-d

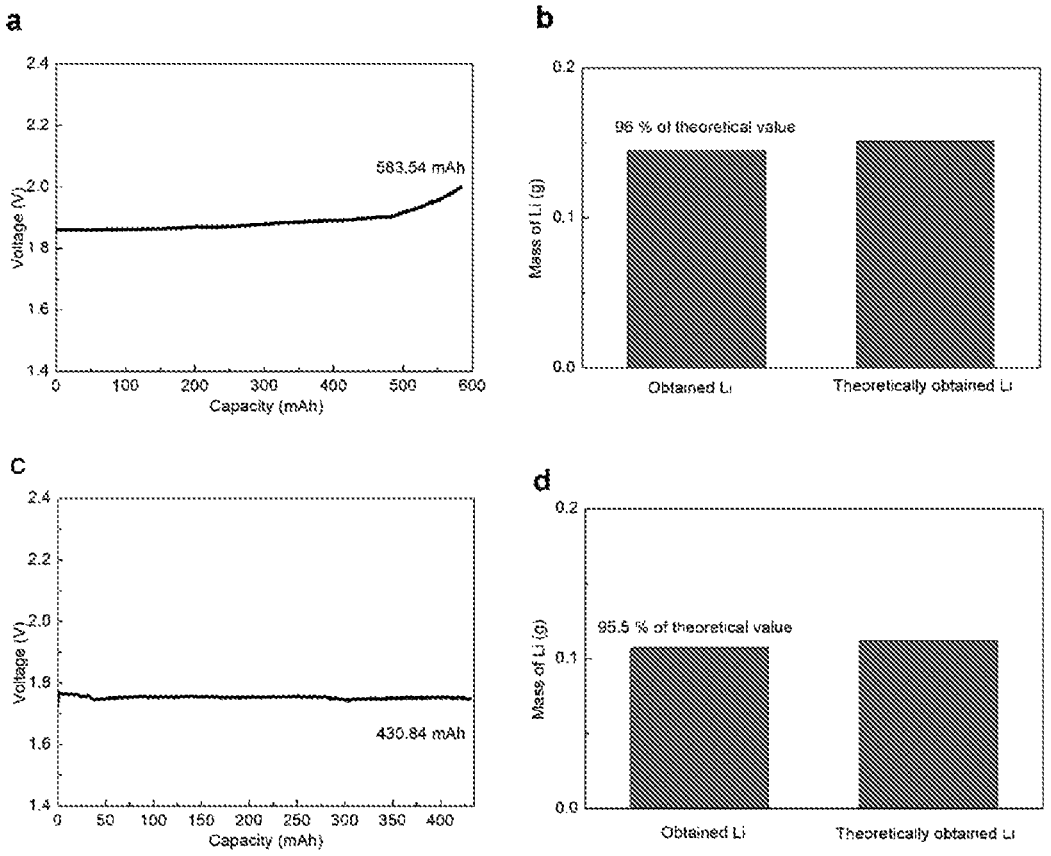
FIG. 4a-d

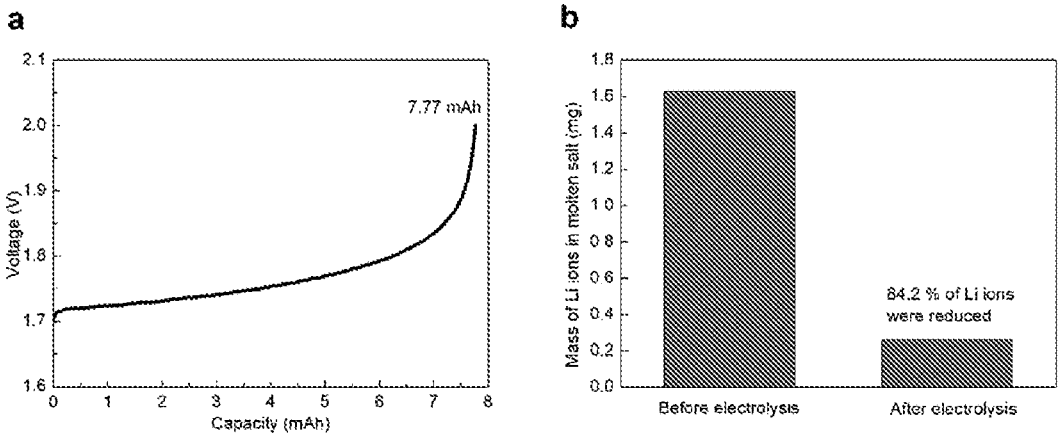
FIG. 5a-b
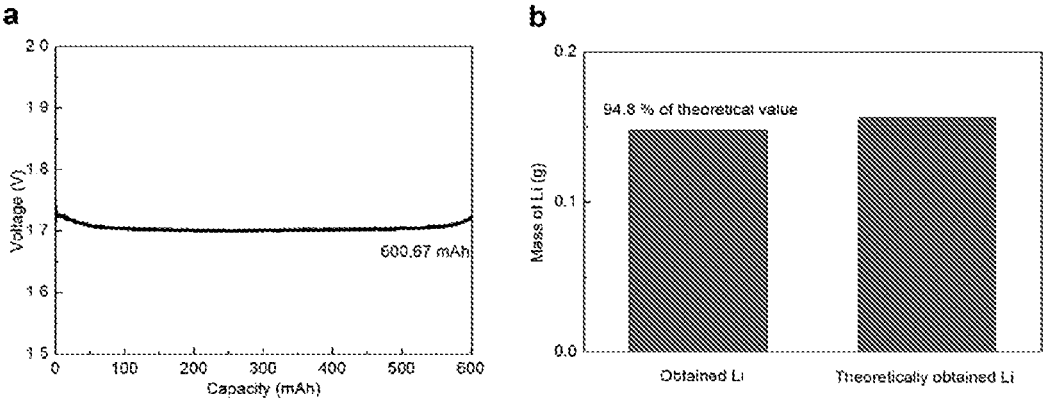
FIG. 6a-b

ELECTROLYTIC PRODUCTION OF HIGH-PURITY LITHIUM FROM LOW-PURITY SOURCES

CROSS REFERENCE TO RELATED APPLICATIONS

This application is a U.S. National Stage Application under 35 U.S.C. 371 of International Application No. PCT/CN2019/125337, filed Dec. 13, 2019, which claims priority to PCT/CN2018/124602, filed Dec. 28, 2018. The contents of each of the aforementioned are hereby incorporated by reference in their entirety into the present disclosure.

BACKGROUND

Lithium possesses the lowest density in standard conditions among metals and this property makes it attractive in light alloys. Li has also been widely used as a chemical reagent for the production of organolithium compounds. For the past few decades, Li ion batteries (LIBs) for portable electronics, electric vehicles and large-scale energy systems have ushered in explosive growth, leading to a significant increase in Li consumption. Although metallic Li is not directly used as electrode materials in the current commercial LIBs, Li metal anodes is indispensable for the next generation rechargeable batteries with high energy density, such as all-solid state lithium metal batteries and Li—S batteries. The demand for metallic Li has been expected to increase dramatically in the next decades. The sustainability of Li resources has attracted more and more attention from academic research community and industry field. Li recovery from low grade salt lakes and sea water may provide practical solutions for the sustainable development of Li resources.

Improved methods of purifying lithium from national resources, in particular those with low-purity lithium, are desired.

SUMMARY

The present disclosure, in some embodiments, provides devices and methods for purifying lithium from lithium salts, including those with low concentrations of lithium salts. Such methods do not require that the lithium salts from natural sources are purified first. Further, the operating temperatures are significantly reduced. Accordingly, as compared to conventional methods, the present technology significantly reduces the cost and time in lithium purification.

In accordance with one embodiment of the present disclosure, therefore, provided is a method of electrolysis, comprising electrolyzing a molten composition comprising a lithium salt, with an anode in contact with the molten composition and a cathode separated from the molten composition by a solid electrolyte capable of conducting lithium ions, wherein the solid electrolyte allows lithium ions, but not other atoms, to pass through.

In some embodiments, the solid electrolyte that conduct lithium ions comprises a garnet-type oxide, such as a Ta-doped $Li_7La_3Zr_2O_{12}$. Examples of garnet-type oxides include $Li_{7-x}La_3Ta_xZr_{2-x}O_{12}$ wherein x is from 0.1 to 1.0, or preferably from 0.4 to 0.6. Specific examples include, without limitation, $Li_{6.4}La_3Ta_{0.6}Zr_{1.4}O_{12}$, $Li_{6.5}La_3Ta_{0.5}Zr_{1.5}O_{12}$, and $Li_{6.6}La_3Ta_{0.4}Zr_{1.6}O_{12}$.

The solid electrolyte can be present in any physical forms so long as it separate the molten composition from the cathode, such as in the form of a cylinder or a plate. In some embodiments, the solid electrolyte has a cross-sectional thickness from 0.05 cm to 0.6 cm, preferably from 0.15 cm to 0.4 cm. In some embodiments, the solid electrolyte has a relative density greater than to 97%.

The lithium salt in the molten composition, in some embodiments, comprises LiCl. In some embodiments, the molten composition comprises less than 99.7%, less than 97%, less than 50%, less than 1% or ever lower concentration of the lithium salt (e.g., LiCl). The molten composition, in some embodiments, further comprises an aluminum salt, such as $AlCl_3$. The mole ratio of lithium to aluminum is preferably from 20:1 to 1:1.

Also provided, in some embodiments, is an apparatus for purifying lithium, comprising: an electrolyte compartment for storing a molten electrolyte; an anode comprising metallic aluminum positioned to be in contact with the electrolyte when included; a cathode compartment for storing molten lithium; a solid electrode positioned to be in contact with the molten lithium when included; a solid electrolyte positioned between the electrolyte compartment and the cathode compartment, wherein the solid electrolyte allows lithium ions, but not any other atoms, to pass through.

BRIEF DESCRIPTION OF THE DRAWINGS

The drawings described herein are for illustration purposes only. The drawings are not intended to limit the scope of the present disclosure.

FIG. 2*a-b* compare the conventional electrolytic device (a) and a new electrolytic device (b) useful for purifying lithium. a, schematic of the traditional electrolytic device. b, schematic of a new electrolytic device using a LLZTO solid electrolyte.

FIG. 3*a-d* illustrate an electrolytic device of the present disclosure and its physical/electrical properties. a, a schematic of the electrolytic device. A stainless-steel shell was used as the anode current collector, and the stainless-steel rod was used as the cathode current collector. b, a digital photo of the electrolytic device. c, digital photos of the LLZTO solid electrolyte tube. d, ionic conductivity of LLZTO solid electrolyte from 40° C. to 280° C.

FIG. 4*a-d* show the production of electrolytic Li. a, Voltage profile of the electrolytic process. The electrolyte was composed of LiCl (1.09 g), NaCl (0.25 g), KCl (0.32 g), $MgCl_2$ (0.41 g) and $AlCl_3$ (1.14 g). The mass fraction of Li ions was 5.5%. b, The efficiency of the electrolytic process in a. c, Voltage profile of the electrolytic processes. The electrolyte was composed of LiCl (1.27 g), LiBr (0.087 g), LiI (0.134 g), $Na_2SO_4$ (0.142 g) and $AlCl_3$ (1.33 g). d, The efficiency of the electrolytic process in c. The current density of both electrolytic processes was 5 mA cm'. The operating temperature was 240° C.

FIG. 5*a-b* show Li extraction from the molten salt with low Li ion concentration. a, Voltage profile of the electrolytic process. The electrolyte was composed of LiCl (0.01 g), NaCl (1.75 g), KCl (0.30 g), $MgCl_2$ (0.57 g) and $AlCl_3$ (4.00 g). The current density was 1 mA $cm^{-2}$. The operating temperature was 240° C. b, Mass change of Li ions in the electrolyte before and after the electrolytic process.

FIG. 6*a-b* show the production of electrolytic Li with low cost. a, Voltage profile of the electrolytic processes. The electrolyte was composed of the industrial-grade LiCl (1.41 g) and $AlCl_3$ (0.57 g). b, The efficiency of the electrolytic process in a. The current density of the electrolytic processes was 5 mA cm'. The operating temperature was 240° C.

Figure 1:
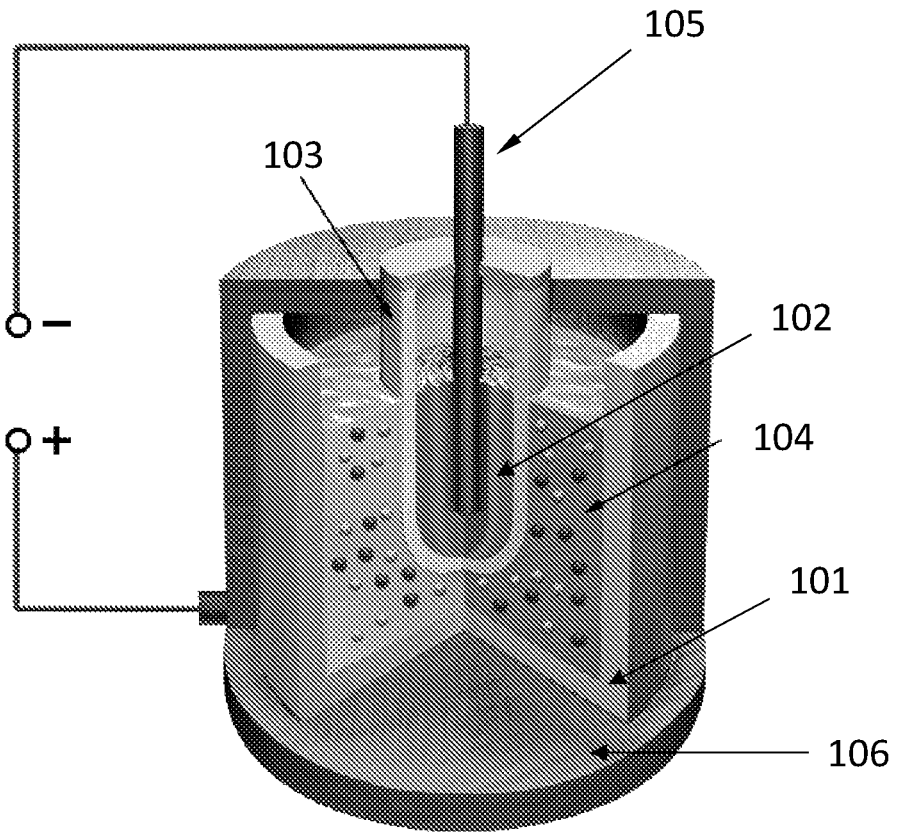
FIG. 1 illustrates an electrolytic device useful for purifying lithium.

Reference is now made in detail to certain embodiments of the present disclosure. While certain embodiments of the present disclosure are described, it will be understood that it is not intended to limit the embodiments of the present disclosure to the disclosed embodiments. To the contrary, reference to embodiments of the present disclosure is intended to cover alternatives, modifications, and equivalents as may be included within the spirit and scope of the embodiments of the present disclosure as defined by the appended claims.

DETAILED DESCRIPTION

For purposes of the following description, it is to be understood that embodiments provided by the present disclosure may assume various alternative variations and step sequences, except where expressly specified to the contrary. Moreover, other than in the examples, or where otherwise indicated, all numbers expressing, for example, quantities of ingredients used in the specification and claims are to be understood as being modified in all instances by the term "about." Accordingly, unless indicated to the contrary, the numerical parameters set forth in the following specification and attached claims are approximations that may vary depending upon the desired properties to be obtained. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges encompassed therein. For example, a range of "1 to 10" is intended to include all sub-ranges between (and including) the recited minimum value of about 1 and the recited maximum value of about 10, that is, having a minimum value equal to or greater than about 1 and a maximum value of equal to or less than about 10. Also, in this application, the use of "or" means "and/or" unless specifically stated otherwise, even though "and/or" may be explicitly used in certain instances.

Industrial production of Li metals relies on the electrolysis of high-purity LiCl. The high complexity and costs associated with obtaining high-purity LiCl, therefore, have severely limited sustainable production of lithium. The present disclosure, in some embodiments, provides new devices and methods that enable preparation of high-purity lithium from low-purity LiCl at low costs, without the need to prepare high-purity LiCl that is required for the conventional processes.

The new method, in some embodiments, takes advantage of an electrolytic system with a solid state electrolyte. The solid state electrolyte, in some embodiment, can conduct lithium ions and allow lithium ions to pass through. The solid state electrolyte, however, does not allow other atoms, in particular cations and other metal atoms, to pass through.

For instance, one embodiment provides a method of electrolysis, comprising electrolyzing a molten composition comprising a lithium salt, with an anode in contact with the molten composition and a cathode separated from the molten composition by a solid electrolyte. The cathode can include a molten lithium, the amount of which will increase during the electrolysis.

Taking advantage of the high Li ion selectivity of the solid electrolyte, such a method enables extraction of high-purity lithium directly from lithium sources with high or low purity of lithium. As demonstrated by the experimental examples, high-purity lithium was obtained from mixed salts with ultra-low concentration of Li (e.g., 0.06 wt. %), showing that even the natural salt from brine can be used as a sustainable source to produce highly pure electrolytic Li.

The new technology described here has at least two significant advantages. First, it shows that high purity Li can be obtained at low costs. The cost of obtaining electrolytic Li as described herein is estimated to be only 20% of the conventional metallic Li methods. Second, in the current technology, lower electrolytic temperature than the conventional electrolytic processes can be used. Further interestingly, when $AlCl_3$ is added to the molten composition, the operating temperature of the electrolytic process can be decreased from 400° C. to 240° C.

Considering that nearly 90% of the recoverable Li resources deposits in the brines, Li recovery from brines is one of the most important methods to obtain Li metals. Industrial production of metallic Li can entail electrolysis of molten LiCl—KCl salt that is extracted and purified from natural resources (FIG. 2*a*). In this process, the molten LiCl is employed for both electrolytic lithium material source and the ionic conducting electrolytes, and therefore, high-purity LiCl and KCl are required to ensure the purity of Li metal products. Otherwise, the impurity cations, such as $Na^+$, $Mg^{2+}$ and $Al^{3+}$ would be deposited at the cathode together with Li metal (FIG. 2*a*). In this process, the purity of LiCl should be higher than 99.3% to produce high-purity Li metals.

Purification of LiCl is highly complex and costly. In particular, some salt lake brines have high Mg/Li ratio, which makes Li recovery difficult. Besides, the LiCl—KCl mixed salt has a high molten point over 350° C. Therefore, the operating temperature is higher than 400° C. In addition, chlorine gas is generated at the anode and can corrode the equipment. The present technology, however, does not have such shortcomings.

The present disclosure, in some embodiments, also provides apparatus that are suitable for use in the presently disclosed methods. In one embodiment, an apparatus for purifying lithium is provided, comprising an electrolyte compartment for storing a molten electrolyte; an anode comprising (or at least partially covered with) metallic aluminum positioned to be in contact with the electrolyte when included; a cathode compartment for storing molten lithium; a solid electrode positioned to be in contact with the molten lithium when included; a solid electrolyte positioned between the electrolyte compartment and the cathode compartment. In some embodiments, the solid electrolyte allows lithium ions, but not any other atoms, to pass through.

A schematic of an example of an electrochemical apparatus that is suitable for the disclosed method is provided in FIG. 1, with the molten electrolyte/composition and molten lithium filled in. The apparatus includes a cathode 102 comprising lithium metal or a lithium metal alloy, and an anode being the molten composition comprising a lithium salt 104 or the cylinder 101 that is electrically connected to the molten composition. A solid electrolyte, in the form of a tube 103 separates the cathode 102 and the molten composition 104. In addition, the apparatus can include a cathode current collector 105 in contact with cathode 102 and is electrically connected to positive electrode 106. The molten composition 104 is in contact with the cylinder 101, which also serves as an anode current collector.

The solid electrolyte can be in the form of an open-ended cylinder or a cylinder in which one of the ends is closed. The one or two open ends of the cylinder can be sealed with a material capable of maintaining the integrity of the seal under operating conditions such as temperatures less than 600° C., and during temperature cycling from 0° C. to 600° C. and when exposed to molten lithium, molten lithium alloy, and molten lithium salts.

Other configurations of an electrochemical apparatus than the configuration illustrated in FIG. 1 are possible. For example, in FIG. 2*b*, the anode, solid electrolyte, and/or cathode can be in the form of parallel plates separating the anode from the cathode.

The solid electrolyte can comprise a material capable of conducting lithium ions. Preferably, the solid electrolyte does not allow other atoms or ions to pass, in particular other metal atoms or ions that can contaminate the purified lithium. The solid electrolyte maintains the separation between the anode and the cathode during use. For example, the solid electrolyte can comprise a lithium ion-conductive oxide, a lithium ion-conductive phosphate, a lithium ion-conductive sulfide, or a combination of any of the foregoing.

Examples of suitable lithium ion conductive oxides include garnet-type oxides, lithium super ionic conductor (LISICON)-type oxides, perovskite type oxides, and combinations of any of the foregoing.

A lithium ion conductive oxide can comprise a garnet-type oxide, such as Ta-doped $Li_7La_3Zr_2O_{12}$. A garnet-type oxide can comprise $Li_{7-x}La_3Zr_{2-x}Ta_xO_{12}$, wherein x can be, for example, from 0.1 to 1.0, from 0.2 to 0.9, from 0.3 to 0.8, or from 0.4 to 0.6.

A garnet-type oxide can comprise $Li_{6.5}La_3Zr_{1.5}Ta_{0.5}O_{12}$. A garnet-type oxide can comprise $Li_{6.4}La_3Zr_{1.4}Ta_{0.6}O_{12}$ (also referred to as "LLZTO" herein). A garnet-type oxide can comprise $Li_{6.6}La_3Zr_{1.6}Ta_{0.4}O_{12}$. A garnet-type oxide can comprise $Li_{6.5}La_3Zr_{1.5}Ta_{0.5}O_{12}$.

Suitable lithium super ionic conductor (LISICON)-type oxides include for example, $Li_{14}ZnGe_4O_{16}$. Suitable perovskite-type oxides include, for example, $Li_{3x}La_{2/3-x}TiO_3$ and $La_{(1/3)-x}Li_{3x}NbO_3$, where x can be, for example, from 0.1 to 1.0, from 0.2 to 0.9, from 0.3 to 0.8, or from 0.4 to 0.7.

Examples of suitable lithium ion conductive-phosphates include $Li_{1.4}Al_{0.4}Ti_{1.6}(PO_4)_3$, $LiZr_2(PO_4)_3$, $LiSn_2(PO_4)_3$, and $Li_{1+x}Al_xGe_{2-x}(PO_4)$, where x can be, for example, from 0.1 to 1.0, from 0.2 to 0.9, from 0.3 to 0.8, or from 0.4 to 0.7.

Examples of suitable lithium ion-conductive sulfides include $Li_2S$—$SiS_2$, $Li_2S$—$GeS_2$—$P_2S_5$, and combinations thereof.

An LLZTO solid electrolyte provided by the present disclosure can have a density greater than 96%, greater than 97%, greater than 98%, or greater than 99%. For example, an LLZTO solid electrolyte can have a density from 96% to 99.9%, from 97% to 99.9%, from 98% to 99.9% or from 98% to 99%.

An LLZTO solid electrolyte provided by the present disclosure can be prepared using high-pressure cold isostatic pressing and spray granulation.

An LLZTO solid electrolyte provided by the present disclosure can have a cross-sectional thickness, for example, from 0.1 cm to 0.6 cm, from 0.15 cm to 0.5 cm, or from 0.2 cm to 4 cm.

The cathode, in some embodiments, comprises a molten lithium. The molten lithium salt in the anode can include any one or more lithium salts available from artificial or natural resources. In some embodiments, the lithium salt comprises LiCl.

The purity of the LiCl, as noted above, does not have to be extremely high as required in the conventional technology. In some embodiments, the molten composition comprises less than 99.7% of the lithium salt. In some embodiments, the molten composition comprises less than 99.5%, 99%, 98%, 97%, 95%, 90%, 80%, 75%, 60%, 50%, 40%, 30%, 20%, 10%, 5%, 1%, 0.5%, 0.1%, or 0.01% of the lithium salt. In some embodiments, the molten composition comprises less than 99.7%, 99.5%, 99%, 98%, 97%, 95%, 90%, 80%, 75%, 60%, 50%, 40%, 30%, 20%, 10%, 5%, 1%, 0.5%, 0.1%, or 0.01% of LiCl.

In some embodiments, the molten composition further comprises an aluminum salt, such as $AlCl_3$. The aluminum salt may be naturally present in the lithium salt, or alternatively can be added prior to or during the electrolysis. In some embodiments, in the molten composition, the mole ratio of lithium to aluminum is from 20:1 to 1:1. In some embodiments, the mole ratio of lithium to aluminum in the molten composition is from 20:1 to 2:1, 20:1 to 3:1, 20:1 to 4:1, 20:1 to 5:1, 20:1 to 6:1, 20:1 to 7:1, 20:1 to 8:1, 19:1 to 2:1, 19:1 to 3:1, 19:1 to 4:1, 19:1 to 5:1, 19:1 to 6:1, 19:1 to 7:1, 19:1 to 8:1, 18:1 to 2:1, 18:1 to 3:1, 18:1 to 4:1, 18:1 to 5:1, 18:1 to 6:1, 18:1 to 7:1, 18:1 to 8:1, 17:1 to 2:1, 17:1 to 3:1, 17:1 to 4:1, 17:1 to 5:1, 17:1 to 6:1, 17:1 to 7:1, 17:1 to 8:1, 16:1 to 2:1, 16:1 to 3:1, 16:1 to 4:1, 16:1 to 5:1, 16:1 to 6:1, 16:1 to 7:1, 16:1 to 8:1, 15:1 to 2:1, 15:1 to 3:1, 15:1 to 4:1, 15:1 to 5:1, 15:1 to 6:1, 15:1 to 7:1, 15:1 to 8:1, 14:1 to 2:1, 14:1 to 3:1, 14:1 to 4:1, 14:1 to 5:1, 14:1 to 6:1, 14:1 to 7:1, 14:1 to 8:1, 13:1 to 2:1, 13:1 to 3:1, 13:1 to 4:1, 13:1 to 5:1, 13:1 to 6:1, 13:1 to 7:1, 13:1 to 8:1, 12:1 to 2:1, 12:1 to 3:1, 12:1 to 4:1, 12:1 to 5:1, 12:1 to 6:1, 12:1 to 7:1, 12:1 to 8:1, 11:1 to 2:1, 11:1 to 3:1, 11:1 to 4:1, 11:1 to 5:1, 11:1 to 6:1, 11:1 to 7:1, 11:1 to 8:1, 10:1 to 2:1, 10:1 to 3:1, 10:1 to 4:1, 10:1 to 5:1, 10:1 to 6:1, 10:1 to 7:1, 10:1 to 8:1, 9:1 to 2:1, 9:1 to 3:1, 9:1 to 4:1, 9:1 to 5:1, 9:1 to 6:1, 9:1 to 7:1, 9:1 to 8:1, 8:1 to 2:1, 8:1 to 3:1, 8:1 to 4:1, 8:1 to 5:1, 8:1 to 6:1, or 8:1 to 7:1.

The cathode current collector can comprise any suitable material such as, for example, stainless steel, copper, copper alloy, carbon, graphite, or a combination of any of the foregoing. The cathode current collector can be inert upon exposure to molten lithium and/or molten lithium alloy.

The anode current collector can comprise any suitable material such as, for example, stainless steel, copper, copper alloy, carbon, graphite, or a combination of any of the foregoing. In some embodiments, the anode current collector comprises metallic aluminum which can be present on the surface in directly contact with the molten composition that contains lithium salt.

Under operating conditions, the electrochemical apparatuses used in these methods can be heated above the melting temperature such that during operation the lithium or lithium salt is molten. For example, under operating conditions, the temperature of the cell can be less than 600° C., less than 500° C., less than 400° C., less than 300° C. or less than 250° C., and above the melting point of the lithium and/or lithium salt.

A sealant can be used to retain the anode/cathode material during use. The sealant can be in the form of a paste or a gasket. It is desirable that the gasket material not degrade and maintain a viable seal under the use conditions of the electrochemical cell. A suitable gasket material will not significantly degrade following long-term exposure to the anode and cathode materials at temperatures within a range from 200° C. to 600° C. or from 200° C. to 300° C. Suitable gasket materials include elastomers such as silicones, perfluoroethers, polytetrafluoroethylene, and polyepoxides.

In some embodiments, the electrochemical apparatus further is connected to or is equipped with a heating element for providing heat to the apparatus.

EXAMPLES

Example 1

One-Step Electrolytic Production of High-Purity Lithium from Low-Purity Sources Using Solid Electrolyte This example describes a new method to produce high-purity electrolytic Li from low-cost and low-purity LiCl using solid state electrolyte (e.g., a garnet-type $Li_{6.4}La_3Ta_{0.6}Zr_{1.4}O_{12}$ (LLZTO)) as the separation layer between two molten electrodes. Taking advantage of the high Li ion selectivity of the solid electrolyte, this example obtained directly high purity metallic Li (Li content>99.7 wt. %) by electrolysis of low-purity LiCl (~95 wt. %). This example further demonstrates Li extraction from mixed salts with low concentration of Li (0.06 wt. %), indicating that the natural salt from brine can be used as a sustainable source to produce electrolytic Li.

The new method to extract Li metal from LiCl as demonstrated here provides at least two significant advantages. First, it shows that high purity Li can be obtained with low-cost. The cost of the electrolytic Li is estimated to be only 20% of the existing metallic Li methods. Second, in the new method, lower electrolytic temperature than the conventional processes can be used. More interestingly, when $AlCl_3$ is added, the operating temperature of the electrolytic process can be decreased from 400° C. to 240° C.

Methods

Process of Garnet Type LLZTO Electrolyte.

$Li_2CO_3$ (Sinopharm Chemical Reagent Co., Ltd, 99.99%), $La_2O_3$ (Sinopharm Chemical Reagent Co., Ltd, 99.99%), $ZrO_2$ (Aladdin, 99.99%) and $Ta_2O_5$ (Ourchem, 99.99%) were fully mixed at the mole ratio of $Li_{6.5}La_3Zr_{0.5}Ta_{1.5}O_{12}$ (20% excess $Li_2CO_3$ were added) and then heated at 900° C. for 6 h. The resulting powders were fully ball milled for 12 h, and then pressed into U-shape tube under 220 MPa cold isostatic pressing for 90 seconds. After that, the tube covered with the same mother powder was annealed at 1140° C. for 16 h in air. All the heat treatments were conducted in alumina crucibles (>99% $Al_2O_3$), covered by alumina lids.

Construction of the Electrolytic Device.

Li metal (0.1 g) was first put into an LLZTO tube and then moved to a box furnace (MTI) for 1 h under 300° C. to melt it. Then the mixed salt was put into the stainless steel-Al shell and was move to a were a box furnace (MTI) for 60 min under 150° C. to melt it to liquid status. Above LLZTO tube with liquid lithium inside was then put into the molten salt under 240° C. A 1 mm diameter stainless steel rod was inserted into the liquid lithium as cathode current collector. The whole assemble process was conducted in an Argon atmosphere glove box.

Electrochemical Measurements.

The electrochemical measurement of the electrolytic process was conducted in a box furnace (MTI) at the temperature of 240° C. All the devices were loaded into an electrolytic test (LAND 2001 CT battery tester) and charged at current densities from 1 mA/cm$^2$ to 10 mA/cm$^2$.

Characterizations.

The relative density of the LLZTO tube was measured by the Archimedes method. The microstructure of all the samples was investigated by scanning electron microscopy with a MERLIN Compact Zeiss scanning electron microscope. The X-ray diffraction (XRD) patterns of the as-fabrication materials were evaluated using a D/max-2500 diffractometer (Rigaku, Japan) equipped with a $CuK_\alpha$ radiation source. The impedance spectroscopy measurement was conducted with a broadband dielectric spectrometer (NOVOCOOL) (frequency range: 10 MHz-40 Hz; AC voltage: 10 mV; temperature: 40-280° C.). The purity of the electrolytic Li and the commercial Li was measured by ICP-MS measurements (ELAN DRC-e).

Results and Analysis

This example demonstrates a new method to produce electrolytic Li based on Li ion solid electrolyte. Using $Li_{6.4}La_3Ta_{0.6}Zr_{1.4}O_{12}$ (LLZTO) ceramic as a solid electrolyte and separator, low-purity LiCl—$AlCl_3$ molten salt as electrolytic raw materials, electrolytic Li metal with high purity was obtained (FIG. 2*b*).

The results demonstrated that the industrial-grade LiCl (~95 wt. %) could be used as raw material to produce high purity electrolytic Li (>99.7 wt. %). The industrial-grade LiCl has a much lower cost than high-purity LiCl. Therefore, the cost of the metallic Li produced by the present method is estimated to be only ~20% of the international metallic Li price. The Li extraction from the mixed salt with low concentration of LiCl (<0.4 wt. %) was also demonstrated. This concentration of Li ion (0.06 wt. %) is at the same magnitude as the natural salt obtained from brines. Over 80% of Li ions was reduced to metallic Li at this ultralow concentration, which indicates that our method can directly extract Li from natural salt in brines.

Figure 7:
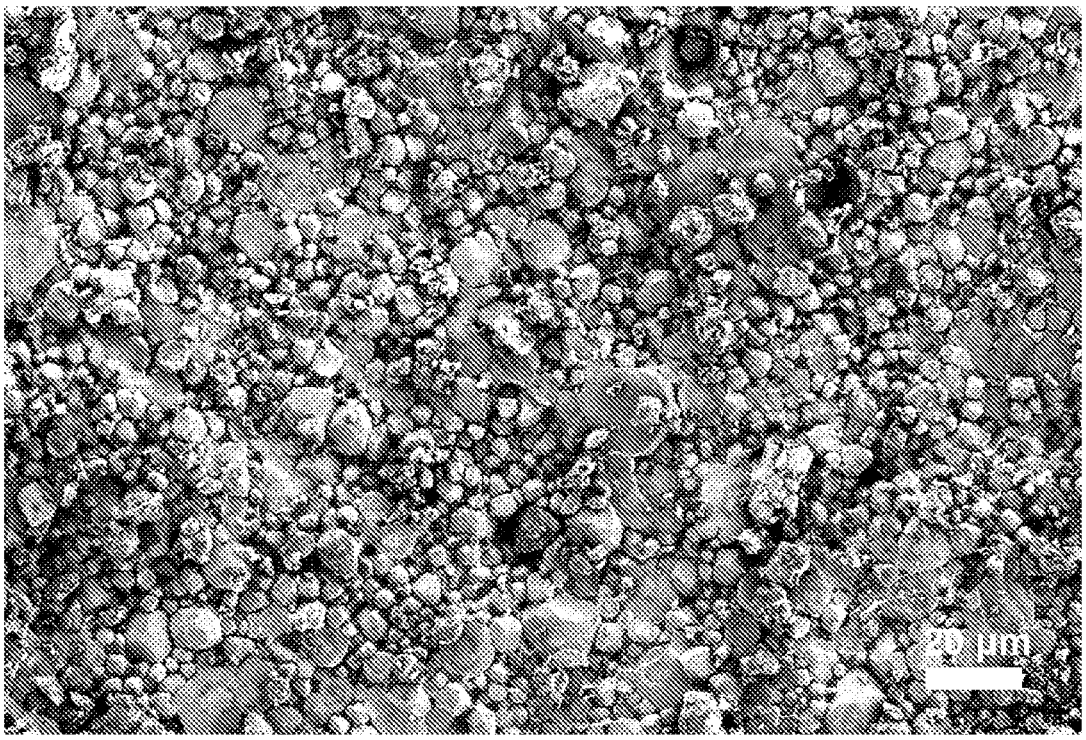
FIG. 7 shows a scanning electron microscope image of the LLZTO solid electrolyte.
Figure 8:
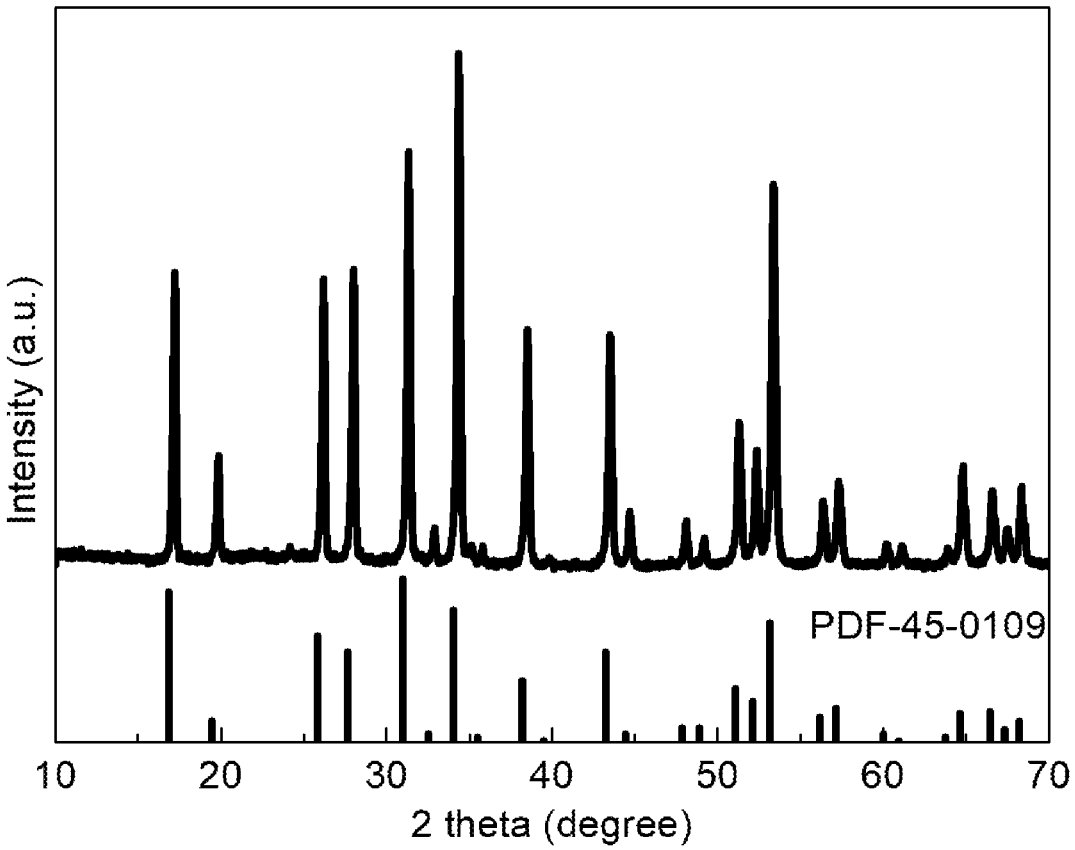
FIG. 8 shows X-ray diffraction patterns of the LLZTO solid electrolyte.

The schematic of the electrolytic device is shown in FIG. 3*a* and its digital photo is shown in FIG. 3*b*. As an important part of the electrolytic device, the LLZTO ceramic tube (FIGS. 3*c*, 7 and 8) exhibited a high conductivity of 38 mS cm$^{-2}$ at 240° C., which was about 100 times higher than that at room temperature (FIG. 3*d*). The ionic conductivity of the solid electrolyte was not an issue in the electrolytic system. The LLZTO ceramic tube also possessed a high relative density of ~99%, preventing leakage of liquid electrodes. As both the cathode (molten Li) and electrolyte (molten salt) are liquid, the interfaces between the solid electrolyte and cathode or electrolyte are liquid-solid interfaces. Therefore, the interfaces keep good contact during the electrolytic process. The above facts indicate that the LLZTO tube can function well as the electrolyte and separator for the electrolytic device.

High Selectivity of the LLZTO Solid Electrolyte

To prove the high selectivity of the LLZTO ceramic tube, a mixed salt composed of LiCl, NaCl, KCl, $MgCl_2$ and $AlCl_3$ was used as electrolyte. Na ions and K ions are common impurities in LiCl raw materials. In the conventional methods, Mg ions are difficult to separate from Li ions when using brines as raw materials to extract LiCl. In the current method, $AlCl_3$ was added to lower the melting point of the mixed salt. Metallic Al was also used as anode, so the electrolytic reaction equations can be expressed as:

$$Al+3Li^{+}+4Cl^{-}\rightarrow 3Li+[AlCl_4]^{-} \quad (1)$$

Only the Li ions can penetrate the solid electrolyte (FIG. 2*b*), and other cations cannot take part in the electrolytic reaction. A small amount of commercial Li was used to connect the LLZTO ceramic tube and the current collector. The voltage profile of the electrolytic process is shown in FIG. 4*a*. The electrolytic voltage was ~1.85 V at the initial stage and kept stable until the capacity reached 500 mAh. The cut-off voltage was 2 V and the final capacity was 583.5 mAh. The cut-off voltage was set to 2 V to prevent the corrosion of the stainless steel shell caused by the molten salt. If 100% of this 583.5 mAh capacity was due to Li metal deposition, this would translate to 0.151 g Li metal. In practice, 0.145 g metallic Li was obtained, which give a Li metal coulombic efficiency of 96.0% (FIG. 4*b*). The difference may be caused by the weighting error and the small amount of side reactions. The electrolytic voltage rise at the final stage was caused by the decline of the Li ion concentration in the electrolyte. According to the initial mass of the LiCl in the mixed salt (1.09 g), this example has extracted ~82% of Li.

To test the purity of the obtained electrolytic Li, inductively coupled plasma mass spectrometry (ICP-MS) measurements was conducted. The commercial metallic Li with the purity of 99.7% was also measured by the same method as comparison. As shown in Table 1, the purities of the commercial Li and the electrolytic Li obtained here are nearly the same. The concentrations of impurities (Na, K, Mg, Al) of the electrolytic Li were very low, also nearly the same as those of commercial Li. The concentrations of La, Ta and Zr elements were extremely low (<0.01 ppm), indicating the high chemical stability of the LLZTO solid electrolyte against the molten Li. It is remarkable that the purity of the obtained electrolytic Li is calculated to be about 99.7%. Considering the initial mass fraction of Li ions in the molten salt (5.5%), the concentration of Li element was improved over 17 times after the electrolytic process. The high purity of the obtained electrolytic Li confirmed the high selectivity and high quality of the LLZTO solid electrolyte.

TABLE 1

ICP-MS measurement results of electrolytic Li, commercial Li and ultra-pure water

| | Li | La | Zr | Ta | Na | K | Mg | Al |
|---|---|---|---|---|---|---|---|---|
| electrolytic Li (ppm) | 1041 | <0.01 | <0.01 | <0.01 | 1.58 | 0.26 | 0.06 | 0.58 |
| commercial Li (ppm) | 1031 | <0.01 | <0.01 | <0.01 | 1.54 | 0.25 | 0.06 | 0.63 |
| ultra-pure water (ppm) | <0.01 | <0.01 | <0.01 | <0.01 | 0.28 | 0.08 | 0.05 | 0.02 |

Other anions, including $Br^{-}$, $I^{-}$ and $SO_4^{2-}$, were also added into the electrolyte and tested for the impact of the anions on the electrolytic process. The voltage profile of the electrolytic process is shown in FIG. 4*c*. The electrolytic voltage was stable at 1.75 V. The electrolytic process was stopped when the capacity reached 430 mAh. If 100% of this capacity is due to Li metal deposition, nearly 50% of Li ions in the mixed salt would be reduced and 0.112 g Li would be obtained. In practice, 0.107 g metallic Li was obtained, which gives a 95.5% coulombic efficiency for Li metal deposition (FIG. 4*d*). According to the results of the ICP-MS measurements (Table 2), the anions showed negligible impact on the purity of the obtained Li. The Cl element was mainly from the ultra-pure water used for the ICP-MS measurements.

TABLE 2

ICP-MS measurement results of electrolytic Li, commercial Li and ultra-pure water

| | Li | La | Zr | Ta | Br | I | S | Cl | Na | Al |
|---|---|---|---|---|---|---|---|---|---|---|
| electrolytic Li (ppm) | 1020 | <0.01 | <0.01 | <0.01 | <0.01 | <0.01 | 0.18 | 1.68 | 1.53 | 0.59 |
| commercial Li (ppm) | 1031 | <0.01 | <0.01 | <0.01 | <0.01 | <0.01 | 0.20 | 1.72 | 1.54 | 0.63 |
| ultra-pure water (ppm) | <0.01 | <0.01 | <0.01 | <0.01 | <0.01 | <0.01 | 0.20 | 1.66 | 0.28 | 0.02 |

Li Extraction from the Raw Materials with Low Concentration of Li Ion

Li extraction from brines with low concentration of Li ions is challenging. To test the extraction ability of the solid electrolyte, this example prepared mixed salts according to the cation ratio of brines from salt lakes. The initial concentration of Li ion was only 0.06 wt. %, which is the average level of several salt lakes in China. As shown in FIG. 5*a*, the final capacity is 7.77 mAh, which is slightly higher than the theoretical value (6.28 mAh). The difference is mainly caused by side reactions. After the electrolysis, the residual salt was dissolved in 100 mL ultrapure water for the ICP-MS measurements. There was 2.58 ppm of Li element remaining in the solution, indicating that 84.2% of Li ions were extracted to form metallic Li (FIG. 5*b*). The purity of the obtained Li metal is as high as that of the commercial high-purity Li metal (Table 3). The concentration of Li element was increased over 1500 times after the electrolytic process. This result demonstrates the potential of our solid electrolyte approach to directly extract Li from natural salt obtained from brines.

TABLE 3

ICP-MS measurement results of electrolytic Li obtained from the mixed salt with low Li ion concentration

| | Li | La | Zr | Ta | Na | K | Mg | Al |
|---|---|---|---|---|---|---|---|---|
| electrolytic Li (ppm) | 1025 | <0.01 | <0.01 | <0.01 | 1.53 | 0.22 | 0.05 | 0.59 |

Producing Electrolytic Li with Low Cost

By using the Li-based solid electrolyte as a layer for Li ion selectivity, the low-purity LiCl with plenty of Na ions, Mg ions, K ions and Al ions, can be used as raw materials to produce metallic Li with a high purity. As LiCl of low purity has a relatively low price, using it as raw material has potential to significantly reduce the production cost of electrolytic Li. To illustrate it potential of this approach, the industrial-grade LiCl (~95 wt. %) and $AlCl_3$ (mole ratio 8:1) were used as electrolyte to produce electrolytic Li. The electrolytic voltage profile is shown in FIG. 6*a*. The electrolytic voltage was stable at ~1.7 V. To avoid the generation of $Al_2Cl_6$ gas, the electrolytic process was stopped when the mole ratio of LiCl and $AlCl_3$ in the electrolyte declined to 1:1. In principle, 65.6% of Li ions were reduced to metallic Li and 0.156 g metallic Li was obtained. In practice, 0.148 g metallic Li was obtained, which is 94.8% of the theoretical value (FIG. 6*b*). The concentrations of the common impurities in the metallic Li production were measured and the results are shown in Table 4. There is no obvious difference between the impurity concentrations of the electrolytic Li and the commercial Li. The most exciting result is that the Mg impurity was very low in the electrolytic Li metal. Mg was known to be challenging to be separated from Li metal from the traditional process due to their similar ionic radius. However, in this case, $Mg^{2+}$ ions diffused very slowly in the Li solid electrolyte due to its divalent charge. The purity of the obtained electrolytic Li was about 99.7% after considering the impurities from the ultra-pure water.

TABLE 4

ICP-MS measurement results of electrolytic Li, commercial Li and ultra-pure water

| | electrolytic Li (ppm) | commercial Li (ppm) | ultra-pure water (ppm) |
|---|---|---|---|
| Li | 1030 | 1031 | <0.01 |
| La | <0.01 | <0.01 | <0.01 |
| Zr | <0.01 | <0.01 | <0.01 |
| Ta | <0.01 | <0.01 | <0.01 |
| Na | 1.59 | 1.54 | 0.28 |
| K | 0.27 | 0.25 | 0.08 |
| Mg | 0.07 | 0.06 | 0.05 |
| Al | 0.63 | 0.63 | 0.02 |
| Cl | 1.75 | 1.72 | 1.66 |
| Ca | 0.19 | 0.18 | 0.18 |
| Fe | 0.02 | 0.02 | 0.01 |
| S | 0.21 | 0.2 | 0.20 |
| Ba | 0.19 | 0.2 | 0.07 |

This example tested a new method to produce electrolytic Li via using solid electrolyte. Owing to the high selectivity of the solid electrolyte, low-purity LiCl with large amounts of other metal cations can be used as raw materials to produce high-purity metallic Li. Compared with the high-purity LiCl, which is used to produce high-purity Li by the traditional electrolysis technology, the industrial-grade LiCl with low purity has a much lower price. The cost of electrolytic Li is reduced significantly in the method. Moreover, the addition of $AlCl_3$ in the electrolyte effectively lowers the operating temperature of the electrolytic device and avoids the generation of the corrosive $Cl_2$. Most notably, the high selectivity of the Li ion solid electrolyte has an outstanding separation effect over those challenging impurities such as Mg ions. Therefore, the salt lake brines with high Mg/Li ratio can be used as a low cost source for the recovery of Li, which can further reduce the cost of electrolytic Li. This example achieved the Li extraction from mixed salts with ultralow concentration of Li ion, making it possible to realize the Li recovery from the natural salt.

Finally, it should be noted that there are alternative ways of implementing the embodiments disclosed herein. Accordingly, the present embodiments are to be considered as illustrative and not restrictive. Furthermore, the claims are not to be limited to the details given herein, and are entitled their full scope and equivalents thereof.

What is claimed is:

1. A method of one-step purification of lithium compounds, comprising electrolyzing a molten composition comprising a lithium salt and an aluminum salt, with an anode at least partially covered by metallic aluminum in contact with the molten composition and a cathode comprising molten lithium separated from the molten composition by a solid electrolyte capable of conducting lithium ions, wherein the solid electrolyte allows lithium ions, but not other atoms, to pass through, and comprises a garnet-type oxide comprises $Li_{7-x}La_3Ta_xZr_{2-x}O_{12}$ wherein x is from 0.4 to 0.6, wherein the solid electrolyte has a relative density from 97% to 99.9%, and wherein after the electrolyzing, a concentration of lithium at the cathode is increased by from 7.2 times to over 1500 times at the molten composition.

2. The method of claim 1, wherein the solid electrolyte is in a form of a cylinder or a plate.

3. The method of claim 2, wherein the solid electrolyte has a cross-sectional thickness from 0.05 cm to 0.6 cm.

4. The method of claim 2, wherein the solid electrolyte has a cross-sectional thickness from 0.15 cm to 0.4 cm.

5. The method of claim 1, wherein the lithium salt comprises LiCl.

6. The method of claim 1, wherein the molten composition comprises less than 99.7 wt % of the lithium salt.

7. The method of claim 6, wherein the molten composition comprises less than 97 wt % of the lithium salt.

8. The method of claim 6, wherein the molten composition comprises less than 50 wt % of the lithium salt.

9. The method of claim 1, wherein the aluminum salt is $AlCl_3$.

10. The method of claim 1, wherein a mole ratio of lithium to aluminum in the molten composition is from 20:1 to 1:1.

11. An apparatus for one-step purification of lithium compounds, comprising:

an electrolyte compartment for storing a molten electrolyte comprising a lithium salt and an aluminum salt;

an anode comprising metallic aluminum positioned in contact with the molten electrolyte;

a cathode compartment for storing molten lithium;

a solid electrode positioned in contact with the molten lithium;

a solid electrolyte positioned between the electrolyte compartment and the cathode compartment, wherein the solid electrolyte allows lithium ions, but not any other atoms, to pass through, and comprises a garnet-type oxide comprises $Li_{7-x}La_3Ta_xZr_{2-x}O_{12}$ wherein x is from 0.4 to 0.6, wherein the solid electrolyte has a relative density from 97% to 99.9%, and wherein after the purification, the apparatus is configured to increase a lithium concentration in the molten lithium by from 7.2 times to over 1500 times at the molten electrolyte.

12. The apparatus of claim 11, wherein the molten electrolyte comprises less than 50 wt % of the lithium salt.

13. The apparatus of claim 11, wherein the solid electrolyte is in a form of a cylinder or a plate.

14. The apparatus of claim 13, wherein the solid electrolyte has a cross-sectional thickness from 0.05 cm to 0.6 cm.

15. The apparatus of claim 13, wherein the solid electrolyte has a cross-sectional thickness from 0.15 cm to 0.4 cm.

16. The apparatus of claim 11, wherein the lithium salt comprises LiCl.

17. The apparatus of claim 11, wherein the aluminum salt is $AlCl_3$.

18. The apparatus of claim 11, wherein a mole ratio of lithium to aluminum in the molten electrolyte is from 20:1 to 1:1.

* * * * *